US006084970A

United States Patent [19]

Aarts et al.

[11] Patent Number: 6,084,970

[45] Date of Patent: Jul. 4, 2000

[54] MONO-STEREO CONVERSION DEVICE, AN AUDIO REPRODUCTION SYSTEM USING SUCH A DEVICE AND A MONO-STEREO CONVERSION METHOD

[75] Inventors: Ronaldus M. Aarts; Robertus T. J. Toonen Dekkers, both of Eindhoven, Netherlands

[73] Assignee: U.S. Philips Corporation, New York, N.Y.

[21] Appl. No.: 08/963,942

[22] Filed: Nov. 4, 1997

[30] Foreign Application Priority Data

Nov. 15, 1996 [EP] European Pat. Off. ..... 96203206

[51] Int. Cl.[7] ..... H04R 5/00

[52] U.S. Cl. ..... 381/17; 381/306

[58] Field of Search ..... 381/1, 17, 18, 381/19, 22, 23, 300, 306, 307

[56] References Cited

FOREIGN PATENT DOCUMENTS 0190198 11/1983 Japan ..... 381/17

*Primary Examiner*—Minsun Oh Harvey
*Attorney, Agent, or Firm*—Edward W. Goodman

[57] ABSTRACT

The invention provides a method and a device for converting a monaural signal into a stereo signal by selectively allocating frequency bands of the input signal to left or right outputs. In this way, some instruments will be present only in the left output and others only in the right output.

8 Claims, 2 Drawing Sheets

MONO-STEREO CONVERSION DEVICE, AN AUDIO REPRODUCTION SYSTEM USING SUCH A DEVICE AND A MONO-STEREO CONVERSION METHOD

BACKGROUND OF THE INVENTION

1. Field of the Invention

The invention relates to a device comprising an input for receiving an input signal, a first output for supplying a left channel output signal, and a second output for supplying a right channel output signal.

The invention also relates to an audio reproduction system comprising an audio signal processing circuit including a left channel input, a right channel input, a surround channel input, a left channel output and a right channel output, left channel and right channel loudspeakers coupled to the left channel and right channel outputs, respectively, the circuit comprising the aforementioned device, having the input coupled to the surround channel input, the circuit further comprising localizing means having first and second inputs coupled to the first and second outputs of the device, respectively, for localizing output signals of the device at virtual sound sources located away from the left channel and right channel loudspeakers.

The invention further relates to an audio/visual reproduction system including such an audio reproduction system, a cabinet in which a picture display screen and the left channel and right channel loudspeakers are installed.

The invention also relates to a method for processing an input signal into a left channel and a right channel output signal.

2. Description of the Related Art

Present-day audio sets are arranged for reproducing stereo signals. However, not all signal sources are able to provide stereo signals. For instance, some television or radio stations do not broadcast stereo audio signals. This results in a distinct audible difference in the reproduction of monaural signals with respect to stereo signals. It is known to provide some kind of mono to stereo conversion in order to provide the illusion to a listener that a stereo signal is reproduced. However, the illusion of stereo generated with these devices is usually rather limited or results in a coloring of the sound due to the use of phase shifts and/or delays.

SUMMARY OF THE INVENTION

An object of the invention is to provide a device for reproducing a monaural signal as stereo signals with an improved stereo illusion.

A device according to the invention is characterized in that the device comprises means for dividing a predetermined frequency range of the first signal into a plurality of adjacent frequency bands, supplying a first selection of frequency bands to the first output and supplying a second selection of frequency bands to the second output, the first and second selections being substantially disjunct, a sum of the first and second selections covering the predetermined frequency range.

The invention is based on the recognition that the spectral content of a musical instrument is mainly present in only a limited frequency band. Different instruments may thus be present in different frequency bands of the audio signal. By dividing the spectrum of the audio signal into a plurality of adjacent frequency bands and by passing non-identical or substantially disjunct selections of the frequency bands to respective left and right outputs, the musical instruments present in the audio signal are then located in either the left or the right output signal. In this way, an improved illusion of stereo is created.

An embodiment according to the invention is characterized in that the means are arranged for alternately supplying consecutive frequency bands to the first and second outputs, respectively. In this way, a more or less balanced distribution of frequency bands is realized, resulting in a pleasant quasi-stereo image.

An embodiment according to the invention is characterized in that the center frequency of a frequency band is substantially twice the center frequency of a lower numbered adjacent frequency band. By selecting the center frequencies of adjacent frequency bands to differ by a factor of two, it is possible to achieve an adequate separation of musical instruments.

A further embodiment according to the invention is characterized in that the means are arranged for supplying frequencies lower than a lower limit of the predetermined frequency range to both first and second outputs.

Low frequencies are less easy to localize in the sound field and therefore it is not necessary to divide these low frequencies into separate frequency bands. In a preferred embodiment, the lower limit is in the order of 400 Hz.

Another embodiment according to the invention is characterized in that the means are arranged for supplying frequencies higher than an upper limit of the predetermined frequency range to both first and second outputs. Similar to the situation for low frequencies, there is no need to provide filtering for high frequencies, as, due to the short wavelength, a small movement of the head will already result in a difference between sounds perceived by the left and the right ear of a listener and localizing cues provided by placing these frequencies in either left or right channel output signal are not useful.

Utilization of the device according to the invention is especially advantageous in the reproduction of surround sound. Surround sound usually comprises a front left channel, a front right channel and a rear surround channel. By using the device according to the invention in audio reproduction systems suitable for surround sound reproduction, for converting the single rear surround channel into two stereo-like rear surround channels, the illusion of surround sound is greatly enhanced.

BRIEF DESCRIPTION OF THE DRAWINGS

The above object and features of the present invention will be more apparent from the following description of the preferred embodiments with reference to the drawings, wherein.

In the figures, identical parts are provided with the same reference numbers.

DESCRIPTION OF THE PREFERRED EMBODIMENT

In a lot of countries, audio signals are broadcast as stereo signals including a left channel and a right channel signal. Present-day receivers, both for radio and television receivers, are arranged for reproducing stereo signals. However, not all broadcasts are in stereo. In these situations, it is desirable to derive from these monaural broadcasts in some way stereo audio signals. Often devices are used which include delays or phase shifters to obtain an illusion of stereo. A drawback is that these devices often color the audio signal, i.e., some frequencies appear to be accentuated more than others.

The present invention provides a device for converting a monaural signal into a left channel and a right channel stereo, which uses a different approach for creating an illusion of stereo. By dividing the spectrum of the monaural signal into adjacent frequency bands and creating two new signals from two disjunct selections of these bands a quasi-stereo sound is obtained.

Figure 1:
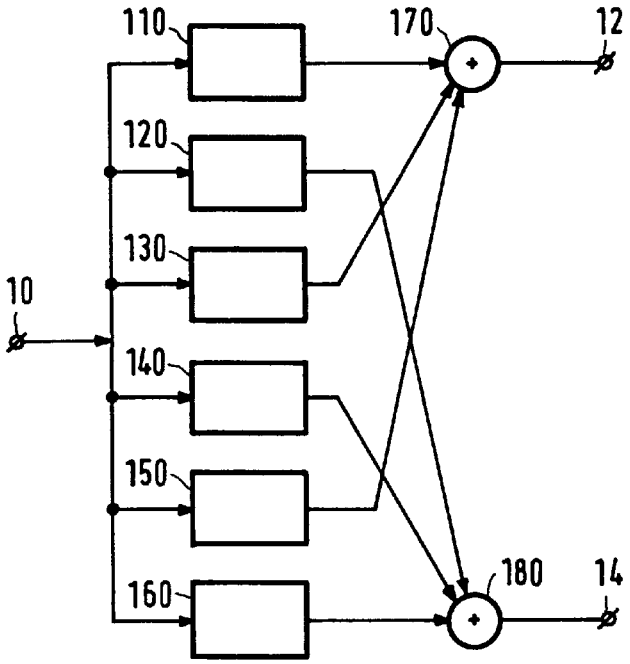
FIG. 1 shows a mono-stereo conversion device according to the invention.

FIG. 1 shows a mono-stereo conversion device according to the invention. The device comprises a plurality of bandpass filters 110 . . . 160, having their inputs coupled to input 10 for receiving an input signal. Outputs of bandpass filters 110, 130 and 150 are coupled to a first adder 170, which supplies the added output signals of the bandpass filters 110, 130 and 150 to the first output 12 for providing a left channel output signal. Outputs of bandpass filters 120, 140, and 160 are supplied to a second adder 180, which supplies the added output signals of these bandpass filters to the second output 14 for providing a right channel output signal. The transfer characteristics of the bandpass filters 110 . . . 160 are preferably chosen such that when the output signals of all the bandpass filters 110 . . . 160 are added, the resulting transfer function would show a substantially flat curve over most of the audio frequency range.

Figure 2:
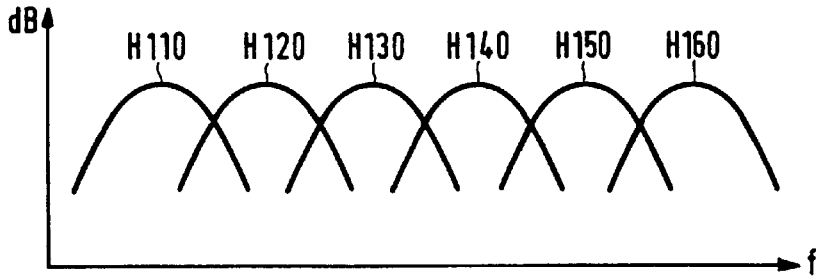
FIG. 2 shows a diagram of the amplitude-vs-frequency transfer curves of the bandpass filters used in the device according to the invention.

FIG. 2 shows a diagram of the amplitude-vs-frequency transfer curves of the bandpass filters used in the device according to the invention. H110, H120, H130, H140, H150 and H160 are the amplitude-versus-frequency transfer curves of bandpass filters 110, 120, 130, 140, 150 and 160, respectively. Preferably the center frequencies of adjacent bandpass filters differ by a factor of 2. This means that the center frequency of bandpass filter 140 is twice the centre frequency of bandpass filter 130, which is in its turn, twice the center frequency of bandpass filter 120. For example, the center frequency of bandpass filter 110 is around 150 Hz, the center frequency of bandpass filter 120 is 300 Hz, etc. Preferably the bandwidth of each bandpass filter is around 1 octave wide.

The invention is based on the recognition that the spectral content of most instruments is mainly present in a limited frequency range. This means that a quasi stereo image can be obtained by passing a first part of the spectrum to the left output 12, which first part may contain a guitar, and a second part of the spectrum of the input signal to the right output 14, this second part may contain for example, a base guitar or other low-frequency instruments. Thus, by dividing the spectrum of the input signal into adjacent frequency bands and distributing these bands between the left output and the right output, a stereo image is realized at the left and right outputs, 12 and 14. Thus, at the left or first output a first selection of frequency bands is present, and at the right or second output, a second selection of frequency bands is present. These first and second selections should not be identical, although some frequency bands may be present in both outputs. In fact, the first and second selections may be disjunct. However, the sum of the first and second selections should cover the frequency range of the input signal, at least for a predetermined part of it. Due to the fact that no extra phase shifts or delays are used to obtain the mono-stereo conversion, there is hardly any coloring of the sound field due to this mono-stereo conversion. This is an advantageous feature.

Figure 3:
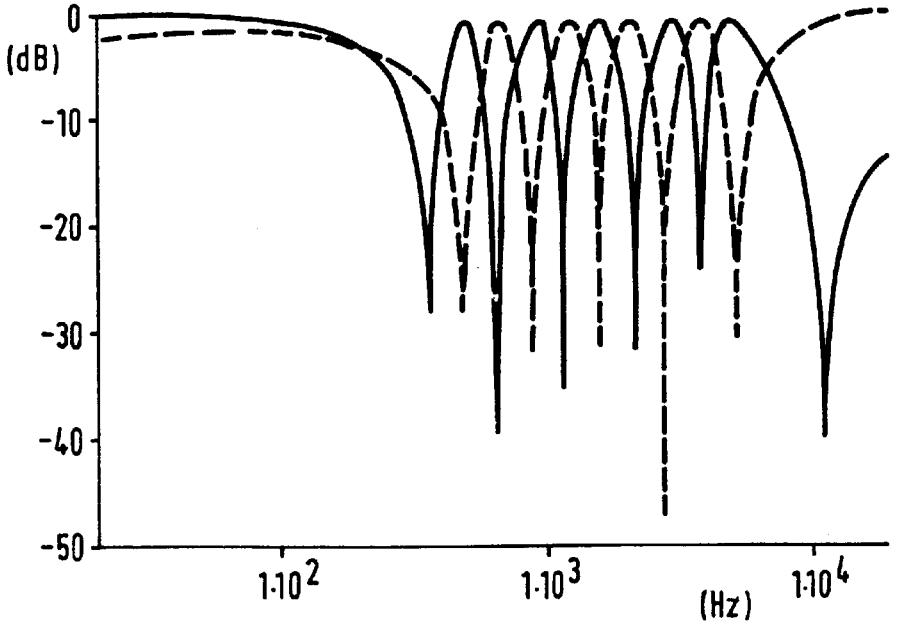
FIG. 3 shows a diagram of alternative amplitude-vs-frequency transfer curves from the input to the outputs of the device according to the invention.

FIG. 3 shows a diagram of alternative amplitude-vs-frequency transfer curves from the input to the outputs of the device according to the invention. The solid curve, for example, shows the transfer curve from the input 10 to the first output 12 and the dashed curve shows the transfer curve from the input 10 to the second output 14. In a predetermined frequency range from around 400 Hz to approximately 10 kHz, it is clear to see that certain frequency bands are passed on only to the first output 12 and others only to the second output 14. Peaks in one curve coincide with dips in the other curve. The allocation of frequency bands to the first or second output may be done on an alternating basis: the first band is passed to the first output, the second band to the second output, the third band to the first output, etc. In this way, the structure resembles a comb-like filter structure.

For frequencies below a 400 Hz lower limit of the predetermined frequency range, no such selection is needed as it is very difficult for a listener to locate the direction of these low-frequency signal components. Therefore these low-frequency components may be present at both first and second outputs 12 and 14, as they do not contribute to the stereo image. For frequencies above a 10 kHz upper limit of the predetermined frequency range, a small movement of the head may already result in different perception of direction of the signal. For Dolby surround signals, the upper limit may even be at 5–7 kHz as the frequency range of the surround signal is already restricted to this upper limit. This means that those high frequencies also do not need to be part of the selections and they may be present in both outputs if so desired, as they also do not contribute significantly to the stereo image. This means, in fact, that, for example, filter 110 can be implemented as a low-pass filter and, for example, filter 160 as a high-pass filter. The curves of FIG. 3 were realized using 6 second-order digital filters.

Figure 4:
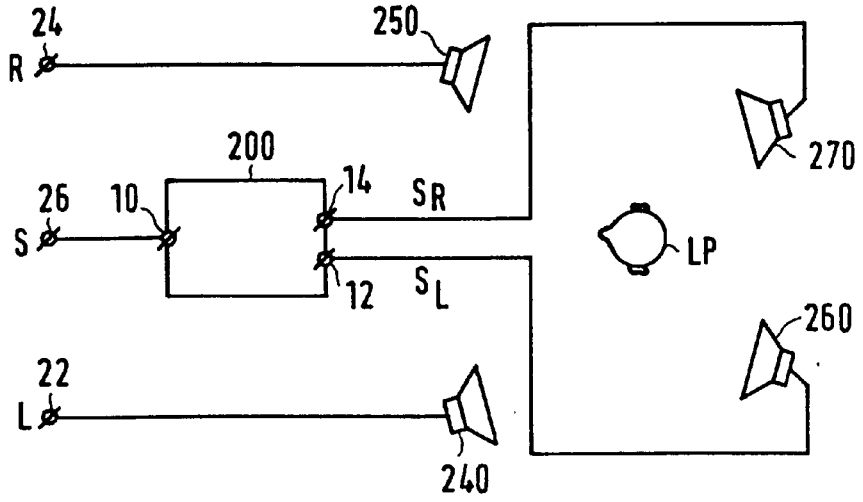
FIG. 4 shows a diagram of a first embodiment of an audio reproduction system comprising a device in accordance with the invention.

FIG. 4 shows a diagram of a first embodiment of an audio reproduction system comprising a device in accordance with the invention. The audio reproduction system is suitable for multi-channel audio signal reproduction and comprises, for this purpose, a first input 22 for receiving a left channel input signal L, a second input 24 for receiving a right channel input signal R and a third input 26 for receiving a third input signal, for example, a surround input signal S. These three input signals may be supplied by, for example a Dolby ProLogic decoder or other surround sound decoders. The first input 22 is coupled to a front left channel loudspeaker 240. The second input 24 is coupled to a front right channel loudspeaker 250. The third input 26 is coupled to input 10 of the conversion device 200, which is the device according to the invention, for example, as shown in FIG. 1. The first output 12 of the device is coupled to a rear left channel loudspeaker 260 and the second output 14 is coupled to a rear right channel loudspeaker 270. The mono-stereo conversion device 200 converts the monaural surround input signal S into a left channel surround signal S1 and a right channel surround signal Sr. The left and right channel surround signals are then reproduced by loudspeakers 260 and 270 arranged behind or next to a listening position LP. By converting the monaural surround signal S into stereo surround signals S1 and Sr the surround sound image is increased. In this embodiment, localization means are arranged for localizing the signals S1 and Sr away from the loudspeakers 240 and 250. These localization means are implemented by the extra loudspeakers 260 and 270 arranged behind the listening position.

Figure 5:
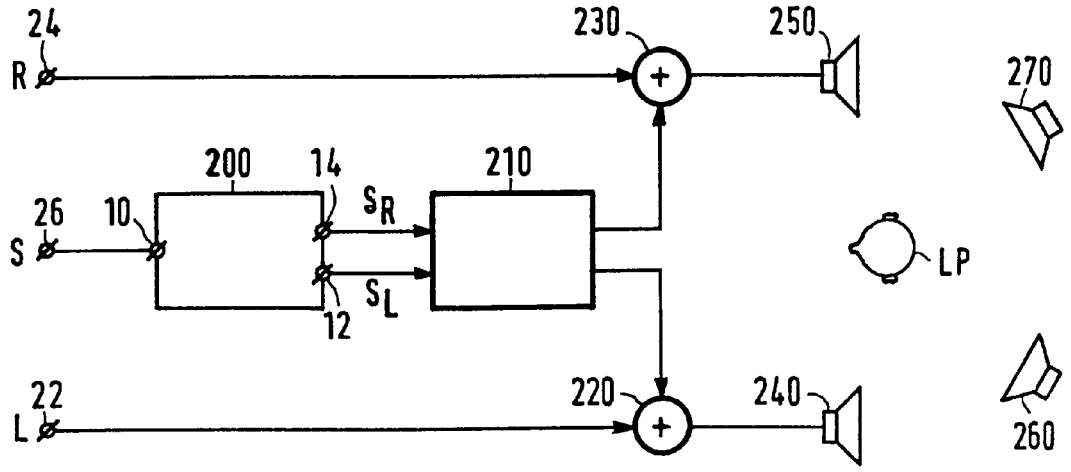
FIG. 5 shows a diagram of a second embodiment of an audio reproduction system.

FIG. 5 shows a diagram of a second embodiment of an audio reproduction system. FIG. 5 differs from FIG. 4 in that:

rear loudspeakers 260 and 270 are deleted, localizing means 210 are provided for localizing the left and right surround signals S1 and Sr at predetermined speaker angles when reproduced through front loudspeakers 240 and 250, first adding means 220 is provided for adding the left channel input signal L and the localized left channel surround signal S1 and supplying the sum to the left channel loudspeaker 240, second adding means 230 for adding the right channel input signal R and the localized right channel surround signal Sr and supplying the sum to the left channel loudspeaker 240.

Now the localization means comprises the first and second adding means 220 and 230, localizing means 210 and in fact the front loudspeakers 240 and 250. The localizing means 210 are arranged for localizing surround signals S1 and Sr at virtual speaker positions 260 and 270 as indicated in FIG. 5. This is done using head-related transfer functions, which is a well-known technique for localizing signals as coming from phantom sources located away from the actual loudspeakers and will therefore not be discussed in detail. Other localizing means may also be used, such as stereo enhancement circuits as known from European Patent Application EP-A 664661. In general, by using the localizing means 210 in this way, it is possible to use only front loudspeakers, and still achieve a surround sound field. This also applies to true 4-channel surround sound systems, wherein the surround sound is built up from a front left channel, a front right channel, a rear left surround channel and a rear right surround channel. For 3-channel surround systems, the mono-stereo conversion provides a more spatial or increased surround effect. An advantage of the use the device 200 according to the invention is that it does not color the sound. This makes it especially suitable for use in combination with localizing means 210. In these embodiments, no attention is given to the possible presence of a front center channel in a surround sound system, as this is not part of the present invention.

Figure 6:
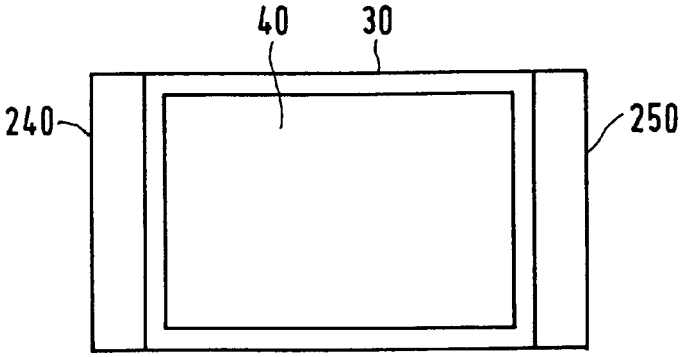
FIG. 6 shows an embodiment for an audio-visual reproduction system in the form of, for example, a television set.

FIG. 6 shows an embodiment for an audio-visual reproduction system in the form of, for example, a television set. The audio-visual reproduction system comprises a cabinet 30 which accommodates a picture display screen 40 for displaying visual images. To the left of the picture display screen 40 the left loudspeaker 240 is positioned. The right channel loudspeaker 250 is arranged to the right of the picture display screen. The loud-speakers 240 and 250 are controlled by the audio signal reproduction arrangement of FIG. 5. In this way, a compact set-up is realized for an audio-visual reproduction system, while still achieving the improved surround sound field.

It will be evident that the device of FIG. 1 can also be used in conventional stereo television sets or audio sets for converting monaural audio signals into stereo audio signals. Furthermore, it is possible to use the device in combination with stereo enhancement circuits as, for example, known from EP-A 664 661.

It will be further evident that the filters may be implemented analog or digital. The order of the filters may be chosen at will, although second-order filter have proven to perform satisfactorily. The number of filters used may also be determined freely and is not restricted to the number of six filters as shown in FIG. 1.

The invention can be used not only in television sets, but also in multi-media sets, sound cards for computer systems, portable audio equipment, etc.

What is claimed is:

1. An audio reproduction system comprising an audio signal processing circuit including a left channel input, a right channel input, a surround channel input, a left channel output and a right channel output, left channel and right channel loudspeakers coupled to the left channel and right channel outputs, respectively, the audio signal processing circuit comprising a device having an input for receiving an input signal, a first output for supplying a left channel output signal, and a second output for supplying a right channel output signal, characterized in that the device comprises:

means for dividing a predetermined frequency range of the input signal into a plurality of adjacent frequency bands; and means for supplying a first selection of said frequency bands to the first output, and for supplying a second selection of said frequency bands to the second output, the first and second selections being substantially disjunct, a sum of the first and second selections covering the predetermined frequency range, the input of said device being coupled to the surround channel input, the audio signal processing circuit further comprising localization means having first and second inputs coupled to the first and second outputs of the device, respectively, for localizing output signals of the device at virtual sound sources located away from the left channel and right channel loudspeakers.

2. The audio reproduction system as claimed in claim 1, characterized in that the supplying means alternately supplies consecutive frequency bands to the first and second outputs, respectively.

3. The audio reproduction system as claimed in claim 1, characterized in that the center frequency of a frequency band is substantially twice the center frequency of a lower numbered adjacent frequency band.

4. The audio reproduction system as claimed in claim 1, characterized in that the supplying means supplies frequencies lower than a lower limit of the predetermined frequency range to both of said first and second outputs.

5. The audio reproduction system as claimed in claim 4, characterized in that lower limit is in the order of 400 Hz.

6. The audio reproduction system as claimed in claim 1, characterized in that the supplying means supplies frequencies higher than an upper limit of the predetermined frequency range to both of said first and second outputs.

7. The audio reproduction system as claimed in claim 6, characterized in that the upper limit is in the order of 10 kHz.

8. An audio/visual reproduction system including the audio reproduction system as claimed in claim 1, and a cabinet in which a picture display screen and the left channel and right channel loudspeakers are installed.

* * * * *